US011208815B2

(12) United States Patent
Rogers

(10) Patent No.: US 11,208,815 B2
(45) Date of Patent: Dec. 28, 2021

(54) SCAFFOLD LEDGER

(71) Applicant: AT-PAC CHINA BUSINESS TRUST, Luxembourg (LU)

(72) Inventor: Peter Rogers, Jiangsu (CN)

(73) Assignee: AT-PAC CHINA BUSINESS TRUST, Luxembourg (LU)

( * ) Notice: Subject to any disclaimer, the term of this patent is extended or adjusted under 35 U.S.C. 154(b) by 224 days.

(21) Appl. No.: 16/427,776

(22) Filed: May 31, 2019

(65) Prior Publication Data

US 2019/0390470 A1 Dec. 26, 2019

(51) Int. Cl.

| | |
|---|---|
| ***E04G 7/32*** | (2006.01) |
| ***E04G 7/02*** | (2006.01) |
| ***E04G 1/04*** | (2006.01) |

(52) U.S. Cl.

CPC ..... *E04G 7/32* (2013.01); *E04G 1/04* (2013.01); *E04G 7/02* (2013.01)

(58) Field of Classification Search

CPC .... E04G 7/32; E04G 7/02; E04G 7/00; E04G 7/06; E04G 7/08; E04G 7/12; E04G 7/14; E04G 7/22; E04G 7/24; E04G 7/30; E04G 7/301; E04G 7/302; E04G 7/303; E04G 7/304; E04G 7/34; E04G 1/04; F16F 2/06; F16F 2/065; F16F 2/10; F16F 9/023; Y10T 403/7062; Y10T 403/7066; Y10T 403/7067

See application file for complete search history.

(56) References Cited

U.S. PATENT DOCUMENTS

| | | | | | |
|---|---|---|---|---|---|
| 584,738 | A * | 6/1897 | Hoshall | E04G 7/18 | 403/398 |
| 1,060,914 | A * | 5/1913 | Lillow | F16B 7/0426 | 403/312 |
| 2,185,948 | A * | 1/1940 | Pimm | E04G 5/04 | 182/87 |
| 2,308,831 | A * | 1/1943 | Roney | F16B 7/048 | 403/191 |
| 2,508,661 | A * | 5/1950 | Campbell | B62B 3/0625 | 414/458 |
| 3,082,843 | A * | 3/1963 | Leonard | E04G 5/04 | 182/82 |
| 3,266,208 | A * | 8/1966 | Maggs | E04G 1/152 | 52/651.1 |
| 3,787,131 | A * | 1/1974 | Reachek | E04G 7/22 | 403/234 |
| 3,810,704 | A * | 5/1974 | Lowe | E04G 7/14 | 403/385 |
| 3,854,552 | A * | 12/1974 | Kensrue | E04G 7/28 | 182/222 |

(Continued)

*Primary Examiner* — Alvin C Chin-Shue
*Assistant Examiner* — Shiref M Mekhaeil
(74) *Attorney, Agent, or Firm* — Barnes & Thornburg LLP

(57) ABSTRACT

A scaffold clamp cooperates with a scaffold ledger to accommodate aligned placement of the scaffold clamp to the ledger at modular positions in the length of the ledger. The scaffold clamp includes an inwardly directed alignment lug sized for receipt in one or more clamp locating holes provided in the length of the ledger at modular positions. This arrangement provides accurate securement of the clamp to the ledger at predetermined modular positions and reduces problems that can occur with respect to erection of the scaffold system.

18 Claims, 7 Drawing Sheets

(56) References Cited

U.S. PATENT DOCUMENTS 3,902,817 A * 9/1975 Meir ..... F16B 2/10 403/188
3,944,175 A * 3/1976 Kearney ..... E21F 17/02 248/59
4,234,055 A * 11/1980 Beeche ..... E04G 3/34 182/118
4,275,982 A * 6/1981 Fisco ..... B62B 3/10 414/459
4,371,057 A * 2/1983 Blier ..... E04G 1/32 182/182.4
4,432,435 A * 2/1984 Anderson ..... B66F 1/02 182/229
4,566,819 A * 1/1986 Johnston ..... E04G 7/14 403/385
4,632,221 A * 12/1986 Stanford ..... E04G 7/14 182/186.8
4,741,505 A * 5/1988 Anderson ..... E04G 1/20 248/357
4,958,702 A * 9/1990 Langer ..... E04G 7/307 187/406
4,967,875 A * 11/1990 Beeche ..... E04G 5/04 182/36
5,285,869 A * 2/1994 Rock ..... E04G 7/20 182/178.6
5,560,730 A * 10/1996 Gillard ..... E04G 1/02 403/294
5,615,968 A * 4/1997 Verenski ..... F16B 2/065 403/312
5,683,609 A * 11/1997 Schworer ..... E04G 11/38 249/18
5,894,909 A * 4/1999 Cornish ..... E04G 7/28 182/186.8
5,918,700 A * 7/1999 Gregory ..... E04G 7/308 182/186.8
6,126,122 A * 10/2000 Ismert ..... F16L 3/243 248/74.1
6,343,616 B1 * 2/2002 Houtchens ..... F16L 41/06 137/318
6,354,402 B1 * 3/2002 Masino ..... E04G 1/154 182/178.1
6,976,557 B2 * 12/2005 Becker ..... E04G 5/14 182/113
7,032,712 B2 * 4/2006 Schworer ..... E04G 1/15 182/119
8,141,826 B1 * 3/2012 Gallardo ..... F16L 3/243 248/74.4
8,752,669 B2 * 6/2014 Hofer ..... F16B 12/00 182/178.5
9,181,723 B2 * 11/2015 Schaefer ..... E04H 15/52
2003/0138293 A1 * 7/2003 Sciortino ..... F16B 7/0426 403/385
2003/0155180 A1 * 8/2003 Liew ..... E04G 7/14 182/186.8
2003/0178253 A1 * 9/2003 Tatge ..... E04G 1/14 182/132
2005/0006535 A1 * 1/2005 Brown ..... H02G 3/32 248/70
2007/0074917 A1 * 4/2007 Jaenke ..... F16B 2/065 180/65.1
2008/0202574 A1 * 8/2008 Milano ..... E04H 15/44 135/121
2009/0249591 A1 * 10/2009 Melic ..... E04G 7/14 24/517
2010/0006481 A1 * 1/2010 Waites, Jr. ..... B07B 1/4645 209/405
2012/0181111 A1 * 7/2012 Brinkmann ..... E04G 7/307 182/186.8
2012/0228060 A1 * 9/2012 Rogers ..... E04G 7/301 182/178.5
2012/0234418 A1 * 9/2012 Lemoine ..... E04G 7/18 137/798
2013/0015015 A1 * 1/2013 Pedicone, Jr. ..... E04G 5/145 182/113
2014/0123576 A1 * 5/2014 Meyer ..... E04F 15/02452 52/126.6
2014/0299413 A1 * 10/2014 Hayman ..... E04G 7/32 182/186.8
2014/0374568 A1 * 12/2014 Amon ..... E04G 17/16 249/1
2015/0023726 A1 * 1/2015 Thacker ..... E04G 7/32 403/49
2015/0117936 A1 * 4/2015 Hart ..... E04F 11/1865 403/187
2016/0002936 A1 * 1/2016 Cox ..... E04G 1/151 182/130
2016/0115697 A1 * 4/2016 Shaw ..... E04G 5/165 182/150
2017/0121986 A1 * 5/2017 Brinkmann ..... E04G 1/12
2017/0356197 A1 * 12/2017 Rogers ..... E04G 1/12
2018/0044929 A1 * 2/2018 Hayman ..... E04G 1/152
2018/0044932 A1 * 2/2018 Slaven ..... E04G 1/15
2018/0073258 A1 * 3/2018 Mikic ..... E04G 5/046
2018/0119433 A1 * 5/2018 Mikic ..... E04G 5/046
2018/0142716 A1 * 5/2018 DuPree ..... E04G 7/26
2018/0155938 A1 * 6/2018 Kreller ..... E04G 1/04
2019/0338540 A1 * 11/2019 Cerasi ..... E04G 7/301
2020/0080324 A1 * 3/2020 Rogers ..... E04G 1/04
2020/0149301 A1 * 5/2020 Lee ..... E04G 21/3247
2020/0199895 A1 * 6/2020 Matthews ..... E04G 7/307
2020/0224437 A1 * 7/2020 Curtis ..... E04G 7/30
2020/0332537 A1 * 10/2020 Behrbohm ..... E04G 7/32

* cited by examiner

SCAFFOLD LEDGER

CROSS-REFERENCE TO RELATED APPLICATION

This application claims the benefit under 35 U.S.C. § 119(b) and 37 CFR 1.55 of Canadian Patent Application No. 3,006,922, filed May 31, 2018, the disclosure of which is incorporated by reference in its entirety.

FIELD OF THE INVENTION

The present invention relates to a scaffold ledger that is adapted to cooperate with a clamp arrangement for locating of the clamp arrangement at a predetermined point in the length of the ledger.

BACKGROUND OF THE INVENTION

Scaffolding systems are temporary structures used in both new construction and in renovation construction to provide a raised work platform at a desired height. For renovation type construction, the scaffolding system may be required to allow assembly of the scaffolding structure around existing piping or other obstructions. The work platform may be constructed around these structures to provide a safe work surface, even if the work surface is interrupted by these obstructions.

In North America, the most common scaffolding systems are modular scaffolding systems having scaffold posts with securing rosettes or other types of fasteners provided on the posts at fixed increments. Horizontal ledger members releasably connect to the securing rosettes or other fasteners to allow the scaffold system to be quickly assembled. Diagonal bracing members also connect to the securing rosettes. These modular systems have scaffold planks typically with hooks provided at the ends thereof for engaging the ledgers, at opposite ends of the scaffold plank.

These modular systems have ledgers of different lengths to provide flexibility in the layout of the scaffolding system and to meet different requirements. Short ledgers are often used to define a perimeter frame about obstructions. The scaffolding system typically includes securing posts at opposite ends of ledgers with the ledgers being laid out in a rectilinear manner defining cells that can be filled in with scaffold planks. The rectangular cells have securing posts at the corners thereof.

Depending upon the particular requirements, it may be necessary to secure a horizontal ledger between two parallel ledgers that partially define a rectangular cell. Different types of clamp arrangement are known for securement to horizontal ledgers for securing of a ledger at a particular point.

A safe raised working platform is needed for workers and guard rails about any large ports in the working platform, need to be easily provided. It is also desirable the system to provide off grid posts when appropriate.

The present invention provides an improved ledger that assists in the placement and securement of intermediary ledgers within a cell or between ledgers extending within a cell. The system also provides flexibility in the placement of securing posts intermediate the length of a ledger.

SUMMARY OF THE INVENTION

A scaffold ledger, according to the present invention, comprises opposed ledger heads with each ledger head having a captured wedge member for accommodating releasable securement with a ledger support member of a scaffold post. Each of the opposed ledger heads are fixedly connected to opposite ends of an elongate structural member. The elongate structural member includes a series of incrementally spaced clamp locating holes with the space between adjacent clamp locating holes corresponding to a width of modular scaffold planks used with the scaffold ledger as part of a modular scaffold system.

In an aspect of the invention, the series of clamp locating holes are at least three clamp locating holes.

In yet a further aspect of the invention, the series of clamp locating holes include aligned clamp locating holes on each side of the scaffold ledger.

In yet a further aspect of the invention, each clamp locating hole is of a size less than 1 inch in diameter.

According to a further aspect of the invention, the scaffold ledger has at least three clamp locating holes located on each side to the scaffold ledger.

In a different aspect of the invention, a scaffolding system is provided that includes a series of scaffold posts adapted to connect with scaffold ledgers with the scaffold ledgers supporting scaffold planks to form a work platform. Each scaffold ledger comprises opposed ledger heads with a captured wedge member for accommodating releasable securement of the ledger head with the scaffold posts. The opposed ledger heads of each scaffold ledger are fixedly connected to opposite ends of an elongate structural member with the elongate structural member including a series of incrementally spaced clamp locating holes. The incrementally spaced clamp locating holes have a spacing between adjacent clamp locating holes that is a multiple of a width of the scaffold planks. The system includes scaffold ledger clamps with each clamp including a first member pivotally connected to a second member with a central port being defined between the two members that is engageable about any of the scaffold ledgers. At least one of the first and second members includes a locating member projecting into said central port and received in one of said clamp locating holes. The clamp further includes a fastening arrangement engaging the first and second members and operable to fasten the scaffold ledger clamp about any of the scaffold ledgers.

With this arrangement, the scaffold clamps are accurately located at modular positions along the scaffold ledger such as at the junction of two abutting scaffold planks supported at one end from a common ledger. These clamps can be of different designs, i.e., with respect to the type of additional component that can be connected to the scaffold ledger via the clamp. For example, the scaffold clamp preferably includes projecting connecting flanges with each flange having a central port that is adapted to cooperate and lock with any of the ledger heads. With this arrangement, the clamp can be provided at a position intermediate the length of the ledger and aligned with one of the alignment holes and a connecting flange provided for supporting an intermediary ledger. A similar clamp arrangement may be necessary at the opposite end or the ledger could connect with a scaffold post if such a post is at the end of the intermediary ledger.

A modification of this clamp allows for a scaffold post or scaffold rail post to be connected to a ledger at an intermediary point in the length of the ledger. The scaffold clamp includes a spigot type member that projects upwardly from a base plate attached to the top portion of the scaffold clamp. With the scaffold clamp properly aligned, the spigot projects vertically and is adapted to receive the base of a scaffold post or a vertical member of a guard rail to essentially support either of these members from the scaffold ledger at an intermediate point in the length of the ledger.

Further aspects of the invention will be appreciated from a review of the drawings and consideration of the detailed description.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
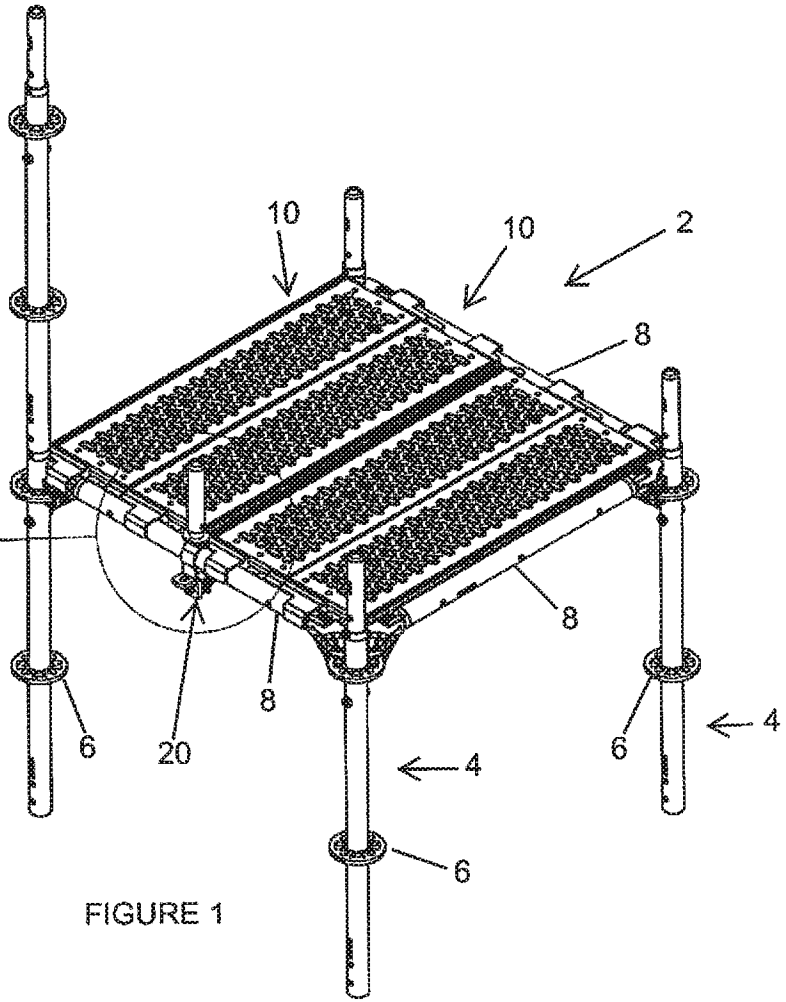
FIG. 1 illustrates a portion of an assembled modular scaffold system where four upright posts are interconnected by horizontal ledgers with scaffold planks covering the area within the cell defined by the scaffold posts and ledgers.

The scaffolding system 2, shown in FIG. 1, includes four upright posts 4 that are connected by horizontal ledgers 8. Typically, in a modular scaffolding system, a series of horizontal ledgers of different modular lengths are provided to accommodate different cell sizes of the scaffold system. A particular cell is defined by the rectangular area bordered by ledgers connecting upright posts provided at the corners of that rectangular area. Scaffold planks are provided in different modular lengths to accommodate different cell sizes. The concept of scaffold planks of different modular lengths and ledgers of different modular lengths has been used for many years as part of modular scaffolding systems. Ledgers are of an appropriate length to support at the ends a whole number of scaffold planks. Essentially, the length of a ledger is a multiple of the width of the scaffold planks. Scaffold planks are of a length corresponding to the length of the ledgers.

The modular scaffolding system preferably includes connectors 6 secured to the upright post at different positions in the length of the upright post for convenient connection to ledger heads of the horizontal ledgers. FIG. 1 shows a preferred rosette type connector 6 secured to the upright post at different positions. Other modular systems may use cup type connectors for securement with the horizontal ledgers. In both systems, connectors 6 are secured to the post at particular predetermined positions and releasably connect with the ledgers.

FIG. 1 also shows the ledger clamp 20 capable of cooperating with any of the ledgers 8 and securable to the ledger at particular modular positions. Further details of this ledger clamp 20 are shown in the exploded view of FIG. 2 where the ledger clamp 20 includes the vertically extending post spigot 22 preferably welded to the base plate 24 which is also welded to a top surface of the clamp 20. The clamp 20 allows an installer to position a post spigot 22 at different modular positions along the length of the ledger. The post spigot 22 can engage either a guard rail post, a scaffold post or other vertical members. This provides a convenient way for securing of these particular components at any of the series of modular positions intermediate the length of the ledger.

Figure 2:
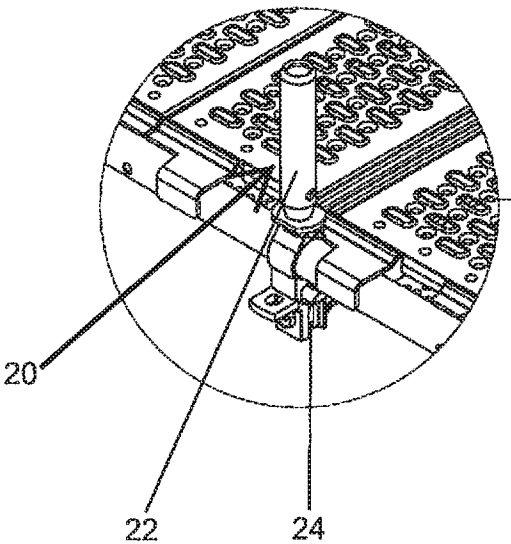
FIG. 2 is a partial perspective view showing a preferred ledger clamp secured to a ledger at a particular placement along the length of the ledger.
Figure 3:
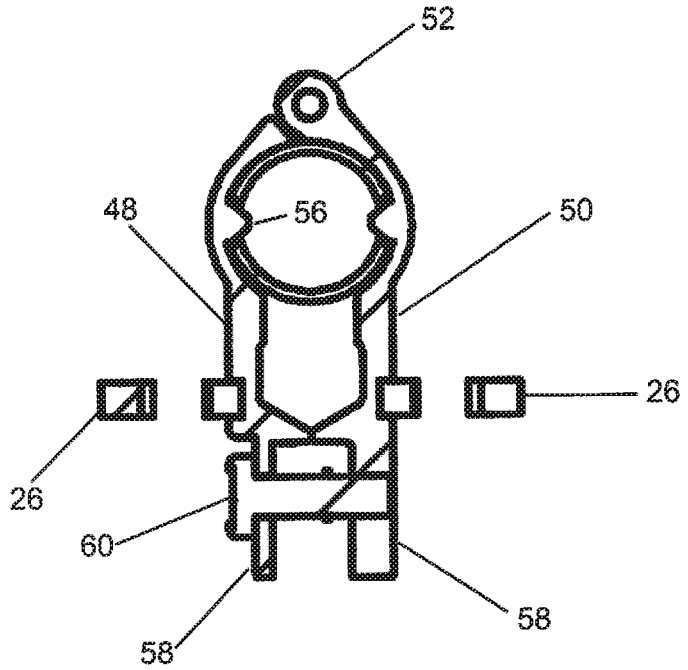
FIG. 3 is a sectional view through a scaffold clamp and ledger with the clamp including two projecting flanges for engaging with the ledger head of a scaffold ledger.
Figure 4:
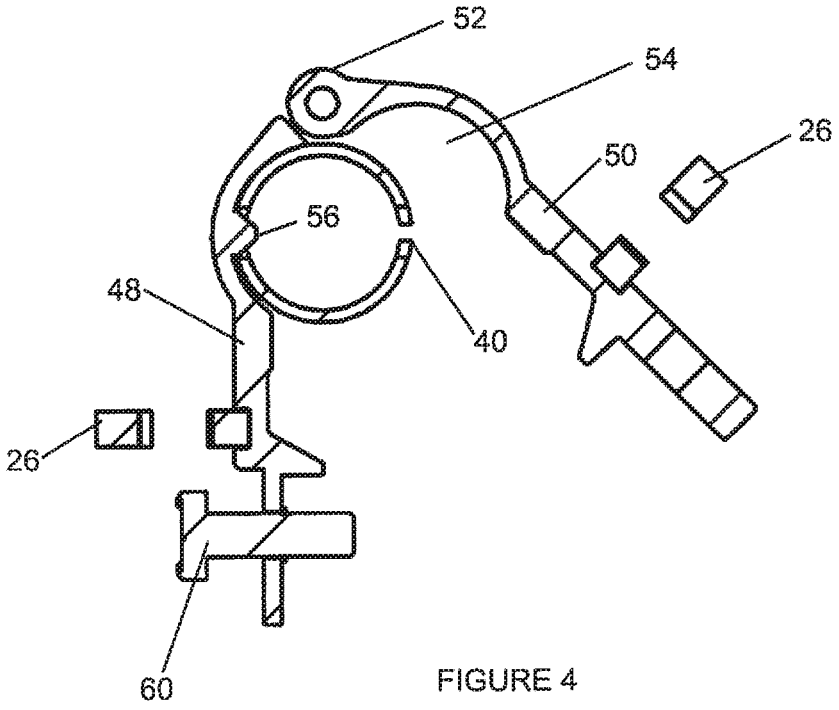
FIG. 4 is a sectional view similar to FIG. 3 with one member of the scaffold clamp pivoted in a counter clockwise direction.
Figure 5:
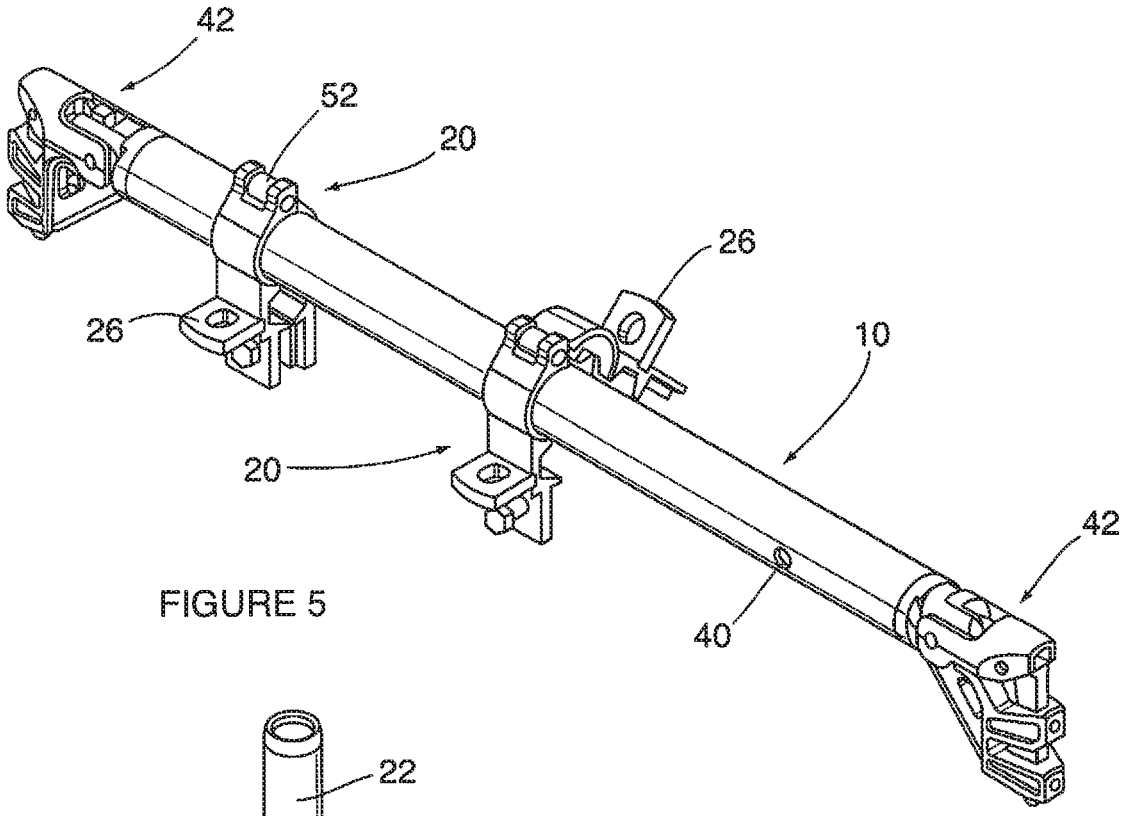
FIG. 5 is a perspective view of the ledger with a first clamp in a position as shown in FIG. 3 and a second clamp being secured to the ledger and being in the relative position as shown in FIG. 4.
Figure 6:
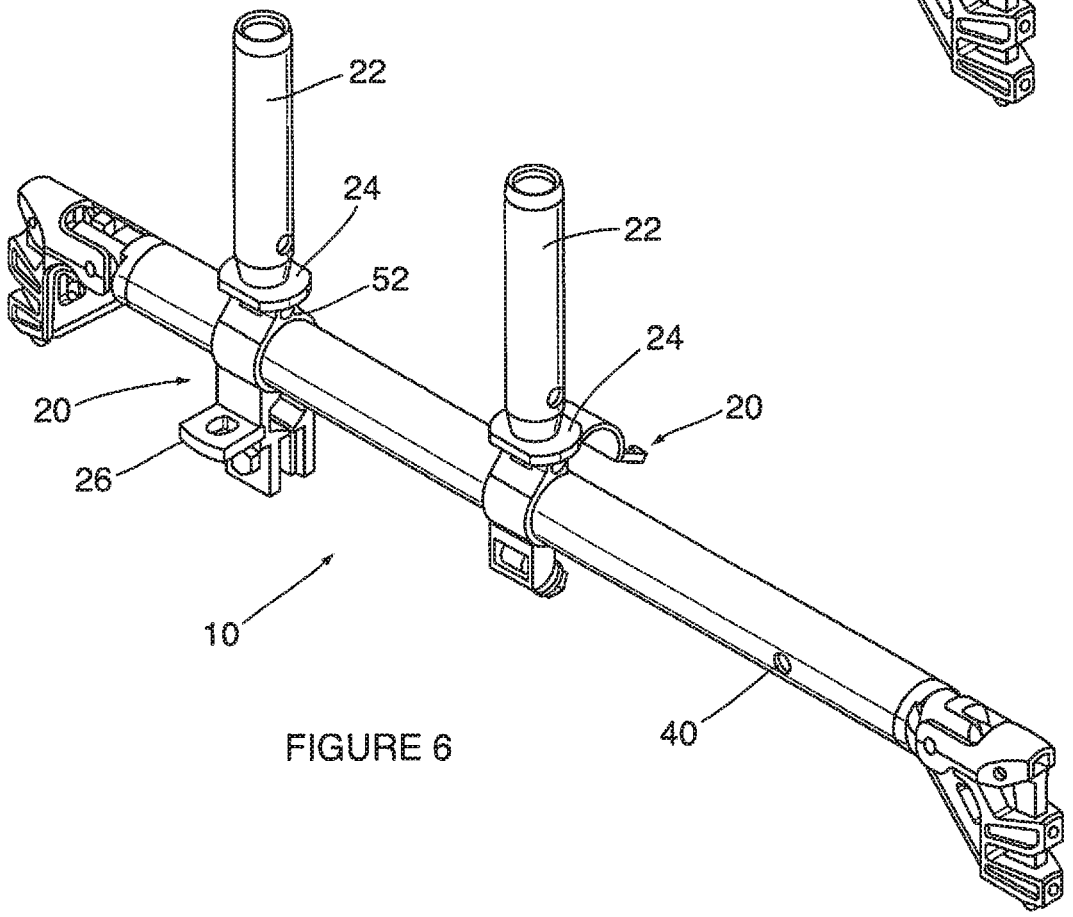
FIG. 6 is a perspective view of a ledger similar to FIG. 5 with the scaffold clamp including a vertically extending spigot.
Figure 7:
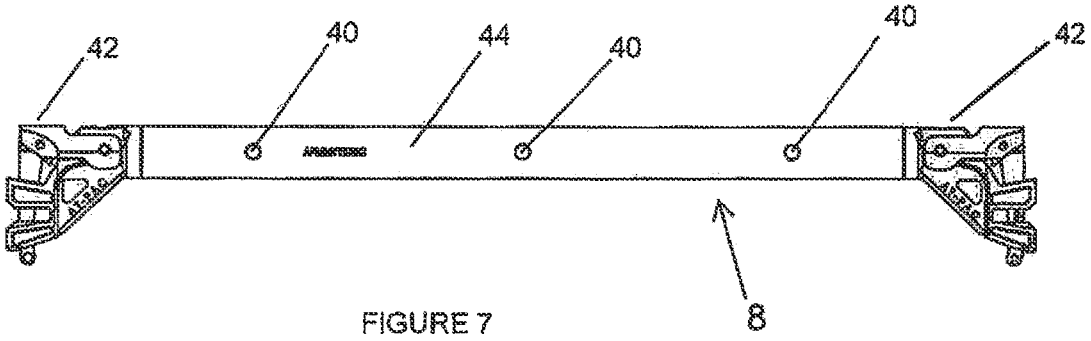
FIG. 7 is a side view of the ledger without any ledger clamps showing the placement of the clamp locating holes.

The ledger clamp 20, as shown in FIGS. 3 through 6, can be of different configurations to suit different requirements. FIG. 2 and FIG. 6 show the ledger clamp with the post spigot 22 extending vertically from the clamp whereas FIGS. 3, 4 and 5 show the ledger clamp 20 with a projecting ledger connector 26 extending from opposite sides of the clamp. The ledger clamp 20 can be adapted for particular purposes, but includes an alignment arrangement for accurately positioning the clamp at predetermined points along the length of the ledger. These predetermined points (modular positions) are shown in FIG. 7. The ledger 8 includes ledger heads 42, elongate structural member 44, and a series of clamp locating holes 40 and these clamp locating holes locate aligning members of the clamp to accurately position the clamp. In the case of a short ledger for end supporting two scaffold planks, there would only be a central clamp locating hole on one side of the ledger. Preferably, a second clamp locating hole is provided on the opposite side.

Returning to FIGS. 3 and 4, the ledger clamp 20 includes a first member 48 connected to the second member 50 by a pivot connection 52. The first member 48 and the second member 50 cooperate to define a ledger cavity 54 essentially immediately below the pivot connection 52. The first member 48 includes an inwardly projecting alignment lug 56 that is received in one of the clamp locating holes 40 of a ledger. With the ledger clamp position in the length of the ledger, the clamp can then be fastened about the ledger by drawing the first member and second member together preferably by means of the bolt and nut fastening arrangement 60 provided on the downwardly extending lever flanges 58. As can be seen, the bolt and nut fastener 60 is located below the projecting ledger connectors 26 and below the elongate tube of the supporting ledger. The ledger connectors 26 have a center port for receiving the wedge type fastener of the ledger heads. In this way, a ledger can be connected to the ledger clamp at the level that the ledger would be if secured between two upright posts. This allows for an intermediary ledger to extend across the cell and essentially underneath or within the depth of abutting planks. With this arrangement, intermediary ledgers can be secured at positions within the cell and provides flexibility to the installer to appropriately provide a work platform about obstacles that are passing through a cell. The connected intermediary ledgers and the primary ledgers used to define the cell of the system are all in the same plane.

FIG. 4 shows the ledger clamp about to be applied about a support ledger and this orientation of the ledger clamp is also shown in two of the clamps with respect to FIGS. 5 and 6. The ledger clamps that are located in the foreground of FIGS. 5 and 6 are being applied to the ledger whereas the rearward clamps are already secured to the respective ledger.

In the Figures, many of the ledgers chow 3 pairs of clamp locating holes (a hole of each pair on opposite sides of the ledger), however, the number of clamp locating holes is a function of the length of the ledgers and various modular lengths will be used.

The spacing between adjacent clamp locating holes on a side of the ledger corresponds to a width of the scaffold planks.

Figure 8:
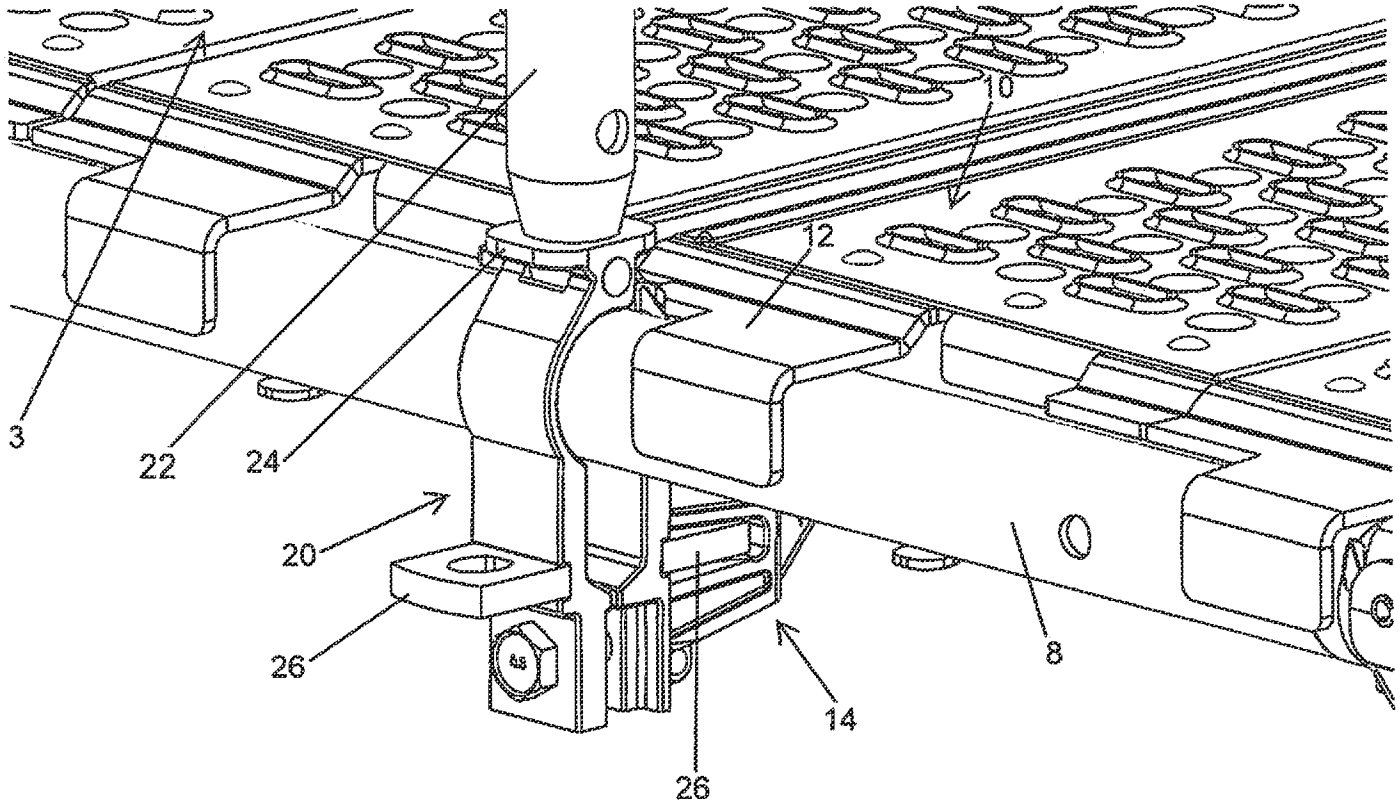
FIG. 8 is a partial perspective view showing a guard rail post secured to a ledger clamp that is secured on a scaffold ledger with scaffold planks supported by the ledger as well as a ledger extending perpendicular to the visible ledger and aligned with the scaffold clamp.

In FIG. 8, it can be seen that an upright post 4 may be placed over the post spigot 22 to cause the post spigot 22 to be interior to that post 4 with the post resting on the base plate 24. The ledger clamp 20 is secured to the horizontal ledger 8 with the ledger clamp engaging one of the clamp locating holes 40. An intermediary ledger 14 is connected to the projecting ledger connector 26 of the ledger clamp and will be secured via a ledger clamp to a corresponding ledger at the opposite side of the cell or an intermediary ledger that would be extending in a perpendicular manner across the cell. If the work platform 3 is to continue to the left side of the ledger 8 shown in FIG. 8, a further intermediary ledger may be necessary. The ledger clamp 20 includes an oppositely extending projecting ledger connector 26 which is freely accessible. The scaffold planks 10 include hooks 12 for passing over the top of the ledger 8 and engaging the opposite side of the ledger. In this way, the scaffold planks are supported at a position with the top surface of the scaffold planks above the top surface of the ledger 8 and a body portion of the plank located in the plane of the ledgers.

Figure 9:
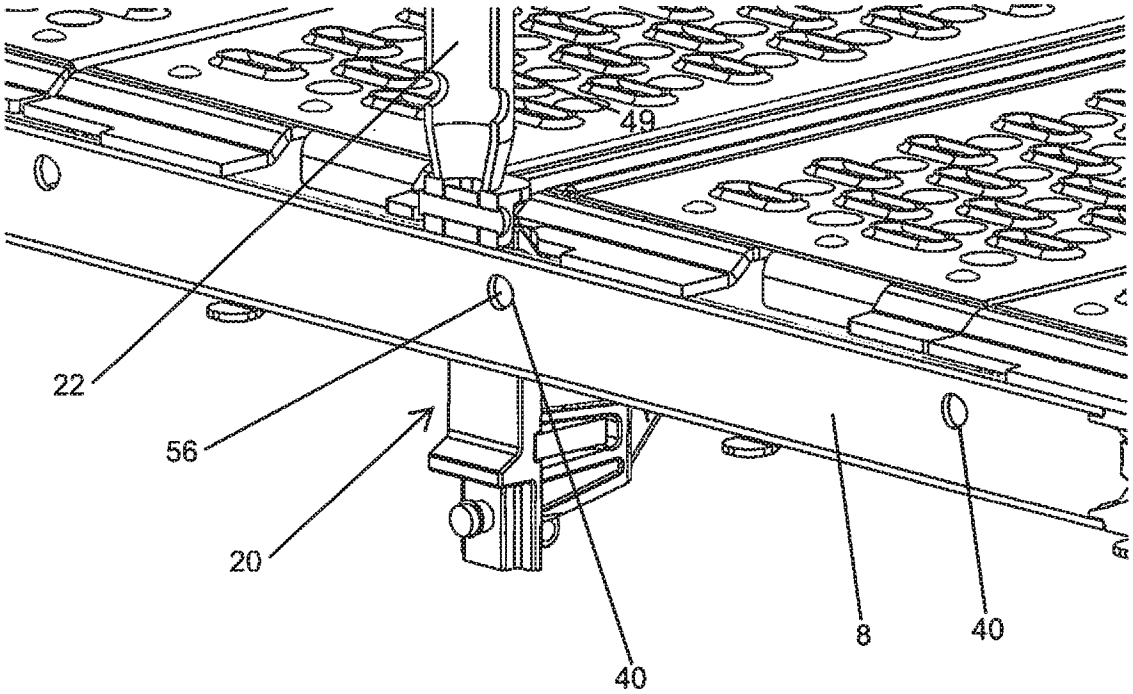
FIG. 9 is a sectional view through the visible ledger of FIG. 8 showing the portion of the ledger clamp secured to the ledger.

In FIG. 9, a sectional view through the ledger 8 is provided showing the ledger clamp 20 is configured for securement with the upright post. The upright post 4 and the post spigot 22 include ports such that a locking member can extend between the aligned ports and lock the upright post 4 to the clamp 20.

The sectional view of FIG. 9 also shows how the inwardly projecting alignment lug 56 is received within one of the clamp locating holes 40.

Figure 10:
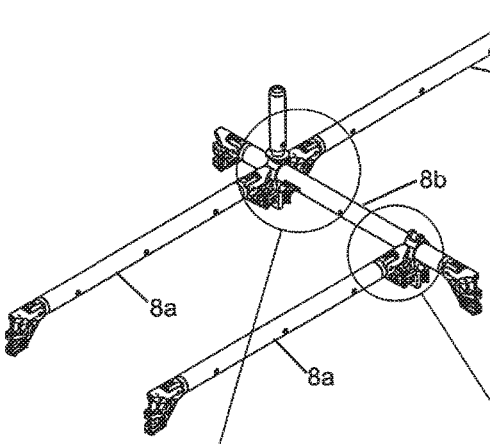
FIG. 10 is a perspective view of 4 connected scaffold ledgers.
Figure 11:
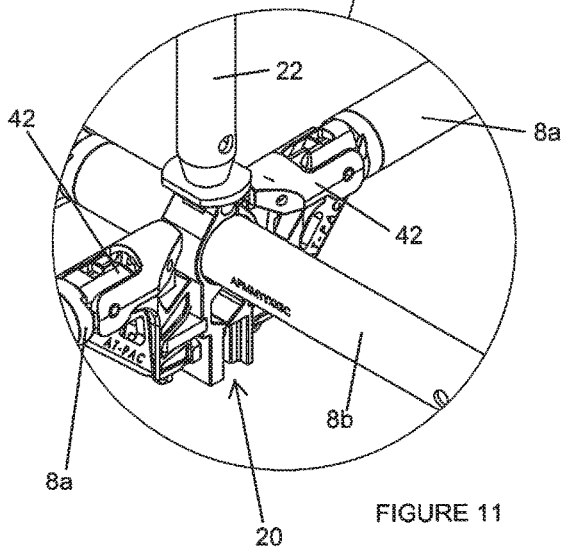
FIG. 11 is a partial perspective view of a ledger clamp connecting ledgers capable of supporting a guard rail post.
Figure 12:
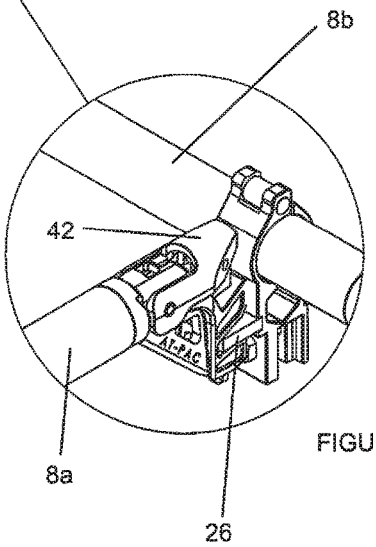
FIG. 12 is a partial perspective view of a ledger clamp connecting two ledgers.

FIGS. 10, 11 and 12 show details of two examples where intermediary ledgers 8*a* are attached by ledger clamps 20 to a primary ledger 8*b* at intermediate positions with respect to the length of the primary ledger 8*b*.

FIG. 11 shows ledger clamp 20 at a first modular position relative to the left ledger head shown in FIG. 10. Clamp 20 includes the post spigot 22 extending in a perpendicular manner to one side of the primary ledger. The intermediary ledgers 8*a* are secured to the ledger connector plates 26 of the ledger clamp 20.

FIG. 12 shows a ledger clamp 20 that only includes the ledger connecting plate 26 engaging the ledger head 42 of the intermediary ledger 8*a*.

The terms "primary ledger" and "intermediary ledger" are used to distinguish how the ledgers are used. Any of the ledgers can be used in either application. The ledger clamp 20 and the series of clamp locating holes 40 provided on the ledgers simplify the erection of the scaffolding system and the placement of intermediary ledgers and/or guard rail posts at appropriate positions to coordinate with supported scaffold planks.

The ledger heads are shown for connection with a scaffold post rosette but other types of fastening arrangements can be used. The ledger heads and the fastening arrangements on the upright posts are designed to operate together. The fastening arrangements on the clamps 20 would also be of a shape for securement with the particular ledger heads.

Although various preferred embodiments of the present invention have been described herein in detail, it will be appreciated by those skilled in the art that variations may be made thereto without departing from the scope of the appended claims.

The invention claimed is:

1. A scaffold system, comprising:

a scaffold ledger that includes an elongate structural member and opposed ledger heads with a captured wedge member for accommodating releasable securement with a ledger support member of a scaffold post; each of said opposed ledger heads being fixedly connected to opposite ends of the elongate structural member;

a modular scaffold plank; and a clamp having a first member, a second member pivotably coupled with the first member, and a ledger connector that extends from the first member, the ledger connector formed to define a port that extends through the ledger connector;

wherein said elongate structural member includes a series of incrementally spaced clamp locating holes with the space between adjacent clamp locating holes being a multiple of a width of the modular scaffold plank used with said scaffold ledger; and wherein the clamp is aligned with at least one of the clamp locating holes and a portion of the clamp extends into the at least one of the clamp locating holes to couple the clamp with the elongate structural member.

2. The scaffold system of claim 1, wherein said series of clamp locating holes are at least 3 clamp locating holes.

3. The scaffold system of claim 1, wherein said series of clamp locating holes include corresponding clamp locating holes on each side of said scaffold ledger.

4. The scaffold system of claim 3, wherein each clamp locating hole is of a size less than 1 inch in diameter.

5. The scaffold system of claim 1, further comprising at least 2 clamp locating holes on each side of said scaffold ledger.

6. The scaffold system of claim 1, wherein said first member and said second member of said clamp define a central port therebetween which receives the elongate structural member of said scaffold ledger, at least one of said first and second members includes a locating member projecting into said central port and received in one of said clamp locating holes, and the clamp further includes a fastening arrangement engaging said first and second members and operable to fasten the clamp to said scaffold ledger.

7. A scaffolding system, comprising:

scaffold planks;

scaffold posts;

scaffold ledgers configured to connect with said scaffold posts to support the scaffold planks, each scaffold ledger comprising an elongate structural member and opposed ledger heads with a captured wedge member for accommodating releasable securement with ledger support members of any of said scaffold posts; each of said opposed ledger heads of one of said scaffold ledgers being fixedly connected to opposite ends of the elongate structural member with said elongate structural member including at least two incrementally spaced clamp locating holes; said incrementally spaced clamp locating holes having a spacing between adjacent clamp locating holes that correspond to a width of said scaffold planks; and scaffold ledger clamps with each scaffold ledger clamp including a first member pivotally connected to a second member with a central port defined therebetween engageable about any of said scaffold ledgers, at least one of said first and second members including a locating member projecting into said central port and received in one of said clamp locating holes, and a fastening arrangement engaging said first and second members operable to fasten the scaffold ledger clamp about any of said scaffold ledgers at a position corresponding to one of said incrementally spaced clamp locating holes.

8. The scaffolding system of claim 7, wherein said first and second members of each clamp when secured to one of said scaffold ledgers has a pivot connection of said first and second members aligned a top of the scaffold ledger.

9. The scaffolding system of claim 8, wherein at least some of said clamps include a scaffold post spigot that projects vertically above said scaffold clamp when said clamp is secured to a scaffold ledger.

10. The scaffolding system of claim 9, wherein each scaffold post is configured to releasably connect to said scaffold post spigot.

11. The scaffolding system of claim 7, wherein each of said first and second members include an outwardly extending scaffold ledger securing flange with a securing port with both said flange and securing port being located at a position below said central port and above said fastening arrangement of the scaffold ledger clamp.

12. The scaffolding system of claim 11, wherein said fastening arrangement is a nut and bolt type connection.

13. A scaffolding system, comprising:

a scaffold ledger that includes an elongate structural member and opposed ledger heads fixedly coupled to opposite ends of the elongate structural member, the elongate structural member formed to include a first clamp locating hole; and a scaffold ledger clamp that includes a first member and a second member pivotally coupled with the first member to define a port between the first member and the second member, the scaffold ledger clamp arranged around the elongate structural member of the scaffold ledger such that the elongate structural member is located in the port, and wherein at least one of the first member and the second member includes a locating member that projects into the port toward the other of the first member and the second member, and the locating member is received in the first clamp locating hole to locate and block movement of the scaffold ledger clamp relative to the scaffold ledger; wherein the scaffold ledger clamp further includes a scaffold post spigot that extends vertically away from the first member and the second member.

14. The scaffolding system of claim 13, wherein the scaffold ledger clamp further includes a ledger connector that extends from the first member and the ledger connector is formed to define a port that extends through the ledger connector.

15. The scaffolding system of claim 13, wherein the scaffold ledger clamp further includes a fastening arrangement engaging said first and second members and operable to fasten the scaffold ledger clamp about the scaffold ledger at a position corresponding to the first clamp locating hole.

16. The scaffolding system of claim 13, wherein the elongate structural member includes a plurality of clamp locating holes that includes the first clamp locating hole and a second clamp locating hole spaced apart from the first clamp locating hole in a direction of a length of the elongate structural member.

17. The scaffolding system of claim 16, wherein the plurality of clamp locating holes includes a third clamp locating hole, the first clamp locating hole is provided on a first side of the elongate structural member, and the third clamp locating hole is provided on a second side of the elongate structural member directly opposite the first clamp locating hole.

18. The scaffolding system of claim 17, wherein each of the plurality of clamp locating holes is a circular hole of a diameter of at least one half inch.

* * * * *